US009647314B1

(12) United States Patent
Nguyen et al.

(10) Patent No.: US 9,647,314 B1
(45) Date of Patent: May 9, 2017

(54) STRUCTURE OF DUAL DIRECTIONAL COUPLERS FOR MULTIPLE-BAND POWER AMPLIFIERS

(71) Applicant: Marvell International Ltd., Hamilton (BM)

(72) Inventors: Huy Thong Nguyen, Singapore (SG); Poh Boon Leong, Cupertino, CA (US); Xiaowei Zhong, Singapore (SG); Sun Shuo, Singapore (SG)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/706,286

(22) Filed: May 7, 2015

Related U.S. Application Data

(60) Provisional application No. 61/989,810, filed on May 7, 2014.

(51) Int. Cl.
*H01P 5/18* (2006.01)
*H01P 5/04* (2006.01)
*H01P 3/08* (2006.01)

(52) U.S. Cl.
CPC . *H01P 5/18* (2013.01); *H01P 5/04* (2013.01)

(58) Field of Classification Search
CPC ..... H01P 5/18
USPC ..... 333/109–112, 116
See application file for complete search history.

(56) References Cited

U.S. PATENT DOCUMENTS 3,863,024 A * 1/1975 Caragliano ..... H04L 25/03127 333/109
5,745,017 A * 4/1998 Ralph ..... H01F 17/0006 329/354
6,515,556 B1 * 2/2003 Kato ..... H01P 5/185 333/116
6,859,177 B2 * 2/2005 Pozdeev ..... H01P 5/186 333/117
8,289,102 B2 * 10/2012 Yamamoto ..... H01P 5/184 333/116
8,837,336 B2 * 9/2014 Tikka ..... H01Q 1/521 370/297
8,981,870 B2 * 3/2015 Colleoni ..... H04L 25/0272 333/109
9,035,718 B2 * 5/2015 Tamaru ..... H01P 5/187 333/109
9,184,485 B2 * 11/2015 Yoshioka ..... H01P 5/187
2013/0207741 A1 * 8/2013 Presti ..... H03H 7/48 333/111
2014/0361953 A1 * 12/2014 Spokoinyi ..... H01P 5/184 343/905
2015/0293304 A1 * 10/2015 Borodulin ..... H01P 5/185 385/42

* cited by examiner

*Primary Examiner* — Dean Takaoka

(57) ABSTRACT

A directional coupler for a wireless communication device includes a first input port, a first output port, a second input port, a second output port, and a coupled port. The first input port and the first output port are respectively configured to receive and provide a first signal to be transmitted from the wireless communication device. The second input port and the second output port are respectively configured to receive and provide a second signal to be transmitted from the wireless communication device. A coupled port is configured to selectively provide a coupled signal corresponding to each of, in respective modes, the first signal and the second signal.

12 Claims, 10 Drawing Sheets

STRUCTURE OF DUAL DIRECTIONAL COUPLERS FOR MULTIPLE-BAND POWER AMPLIFIERS

CROSS-REFERENCE TO RELATED APPLICATIONS

This application claims the benefit of U.S. Provisional Application No. 61/989,810, filed on May 7, 2014. The entire disclosure of the application referenced above is incorporated herein by reference.

FIELD

The present disclosure relates to directional couplers in wireless communication systems.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Wireless communication systems such as 3G and long term evolution (LTE) communication systems rely on feedback and control of a transmit power of signals transmitted between wireless devices. For example, the transmit power may vary due to variations in components of the wireless devices (e.g., mobile phones, tablets, laptop computers, etc.), the wireless communication channel, interference from other electronic devices, and/or other factors. A wireless device transmitting a signal may monitor characteristics of the transmitted signal to adjust the transmit power accordingly.

FIG. 1 shows an example wireless communication device 100 operating in a 3G/LTE wireless communication system. The wireless communication device 100 includes a transmitter 104, a receiver 108, a directional coupler 112, and an antenna 116. The transmitter 104 receives a transmit signal to be transmitted via the antenna 116. For example, the transmitter 104 receives a baseband transmit signal and modulates a radio frequency (RF) carrier based on the baseband transmit signal for transmission as an RF signal via the antenna 116. The receiver 108 receives RF signals via the antenna 116 and converts the RF signals to corresponding receive signals (e.g., baseband receive signals).

The transmitter 104 generates the modulated RF carrier at a desired transit power level. For example, the transmit power level may correspond to a target power level received by the transmitter 104. The transmitter 104 provides the modulated RF carrier to the antenna 116 through the directional coupler 112. The directional coupler 112 couples signals transmitted by the transmitter 104 to the receiver 108. Accordingly, various characteristics of signals transmitted from the transmitter 104 to the antenna 116 through the directional coupler 112 are detectable by the receiver 108. For example, the receiver 108 may detect the transmit power level of the signals transmitted from the transmitter 104 to the antenna 116 based on the coupled signals.

FIGS. 2A and 2B show example directional couplers configured to couple transmitted signals to one or more coupled ports (e.g., a port in communication with a receiver). FIG. 2A shows a uni-directional coupler 200 having an input port 204, an output port 208, a coupled port 212, and a terminated port 216. The input port 204 receives a transmit signal (e.g., from a transmitter) and outputs the transmit signal (e.g., to an antenna) via the output port 208 on a transmit line 220. The transmit line 220 is coupled to a coupling line 224. Accordingly, signals transmitted via the transmit line 220 are coupled (e.g., forward coupled) to the coupling line 224, and characteristics of the signals transmitted via the transmit line 220 are detectable via the coupled port 212.

FIG. 2B shows a bi-directional coupler 228 having an input port 232, an output port 236, a coupled port 240, and an isolated (coupled) port 244. The input port 232 receives a transmit signal and outputs the transmit signal via the output port 236 on a transmit line 248. The transmit line 248 is coupled to a coupling line 252. Accordingly, signals transmitted via the transmit line 248 are coupled (e.g., forward coupled) to the coupling line 252, and characteristics of the signals transmitted via the transmit line 248 are detectable via the coupled port 240. Conversely, any signals incidentally received on the transmit line 248 (e.g., from the antenna) are detectable via the isolated port 244.

FIGS. 3A and 3B show example dual-directional couplers configured to couple transmitted signals to one or more coupled ports. FIG. 3A shows a dual-directional coupler 300 in a series arrangement. The dual-directional coupler 300 includes an input port 304, an output port 308, a forward coupled port 312, a reverse coupled port 316, and terminated ports 320 and 324. The input port 304 receives a transmit signal and outputs the transmit signal via the output port 308 on a transmit line including transmit line portions 328 and 332. The transmit line portion 328 is forward coupled to a coupling line 336 and the transmit line portion 332 is reverse coupled to a coupling line 340. Accordingly, signals on the transmit line portion 328 are forward coupled to the coupling line 336, and characteristics of the signals are detectable via the coupled port 312. Conversely, signals on the transmit line portion 332 are reverse coupled to the coupling line 336, and characteristics of the signals are detectable via the coupled port 316.

FIG. 3B shows a dual-directional coupler 344 in a parallel arrangement. The dual-directional coupler 344 includes an input port 348, an output port 352, a forward coupled port 356, a reverse coupled port 360, and terminated ports 364 and 368. The input port 348 receives a transmit signal and outputs the transmit signal via the output port 352 on a transmit line 372. The transmit line 372 is forward coupled to a coupling line 376 and reverse coupled to a coupling line 380. Accordingly, signals on the transmit line 372 are forward coupled to the coupling line 376, and characteristics of the signals are detectable via the coupled port 356. Conversely, signals on the transmit line 380 are reverse coupled to the coupling line 380, and characteristics of the signals are detectable via the coupled port 360.

SUMMARY

A directional coupler for a wireless communication device includes a first input port, a first output port, a second input port, a second output port, and a coupled port. The first input port and the first output port are respectively configured to receive and provide a first signal to be transmitted from the wireless communication device. The second input port and the second output port are respectively configured to receive and provide a second signal to be transmitted from the wireless communication device. A coupled port is configured to selectively provide a coupled signal corresponding to each of, in respective modes, the first signal and the second signal.

In other features, a third input port and a third output port are respectively configured to receive and provide a third signal to be transmitted from the wireless communication device. The coupled signal corresponds to, in a respective mode, the third signal. In embodiments, the coupled port corresponds to a forward coupled port. In other embodiments, the coupled port corresponds to a reverse coupled port.

In other features, the first signal corresponds to a first transmission band and the second signal corresponds to a second transmission band. The directional coupler includes a second coupled port configured to provide a second coupled signal corresponding to each of, in respective modes, the first signal and the second signal.

A method of operating a directional coupler for a wireless communication device includes receiving and providing a first signal to be transmitted from the wireless communication device at a first input port and a first output port, respectively, receiving and providing a second signal to be transmitted from the wireless communication device at a second input port and a second output port, and selectively providing, using a coupled port, a coupled signal corresponding to each of, in respective modes, the first signal and the second signal.

In other features, the method includes receiving and providing a third signal to be transmitted from the wireless communication device at a third input port and a third output port, respectively, wherein the coupled signal corresponds to, in a respective mode, the third signal. The coupled signal corresponds to, in a respective mode, the third signal. In embodiments, the coupled port corresponds to a forward coupled port. In other embodiments, the coupled port corresponds to a reverse coupled port.

In other features, the first signal corresponds to a first transmission band and the second signal corresponds to a second transmission band. The method further includes providing, at a second coupled port, a second coupled signal corresponding to each of, in respective modes, the first signal and the second signal Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

In the drawings, reference numbers may be reused to identify similar and/or identical elements.

DESCRIPTION

Wireless communication devices operating in a 3G/LTE wireless communication systems may operate in multiple (e.g., two or more) frequency bands and/or modes. For example, a wireless communication device may be configured to operate in a low band, a high band, a very high band, etc., and to transition between the bands. The wireless communication device may include a plurality of power amplifiers (PAs) such that a transmission path for each of the frequency bands includes a respective PA. A directional coupler according to the principles of the present disclosure is configured to provide a single forward coupled port (and/or a single reverse coupled port) for two or more transmit signals corresponding to different frequency bands.

Figure 1:
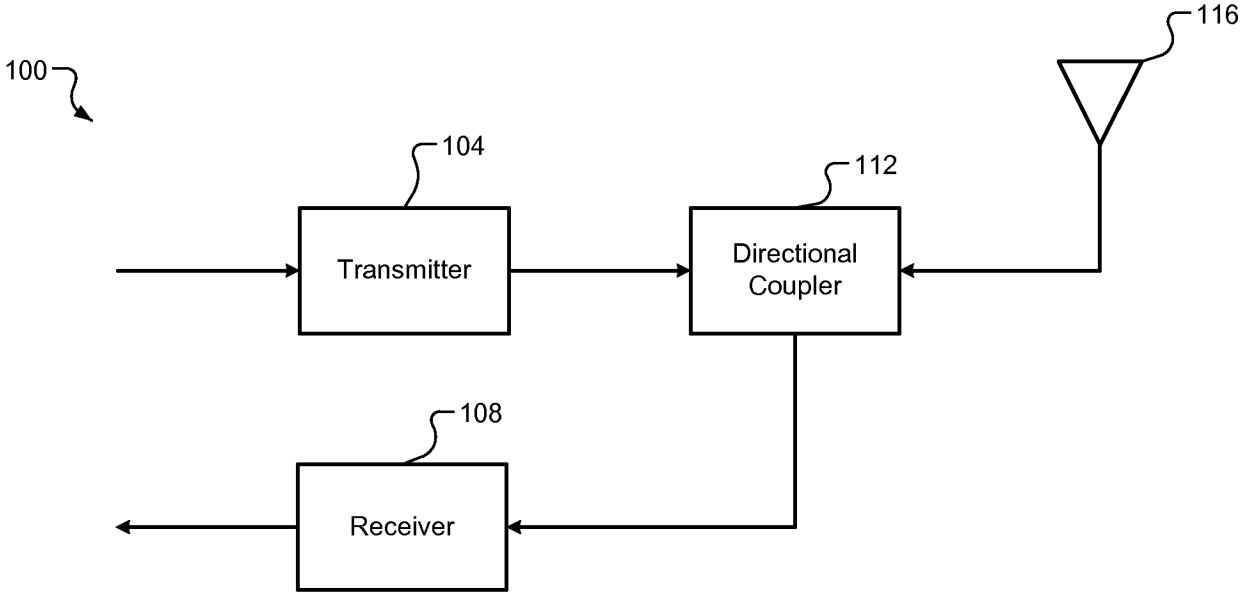
FIG. 1 Prior Art
FIG. 1 is an example wireless communication device operating in a 3G/LTE wireless communication system.
Figure 2B:
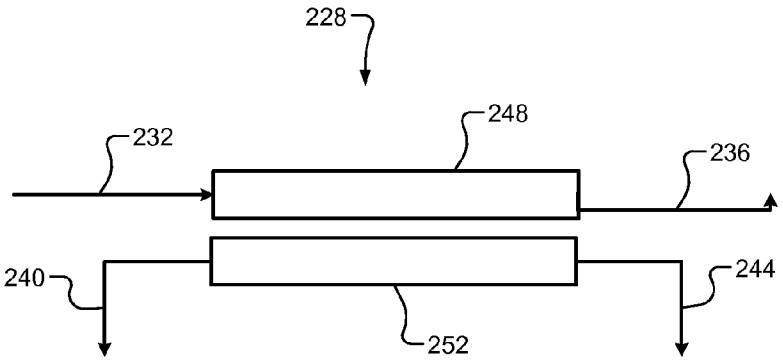
FIG. 2B Prior Art
FIG. 2B is an example bi-directional coupler.
Figure 2A:
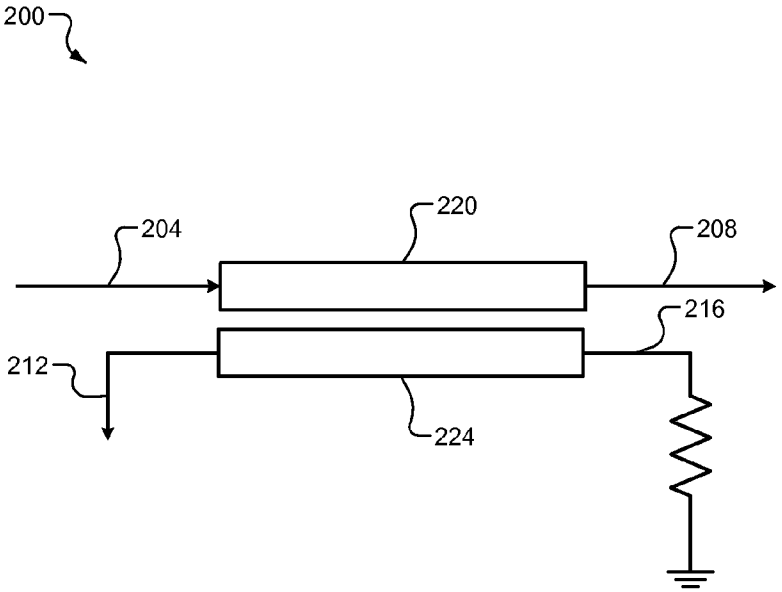
FIG. 2A Prior Art
FIG. 2A is an example uni-directional coupler.
Figure 3A:
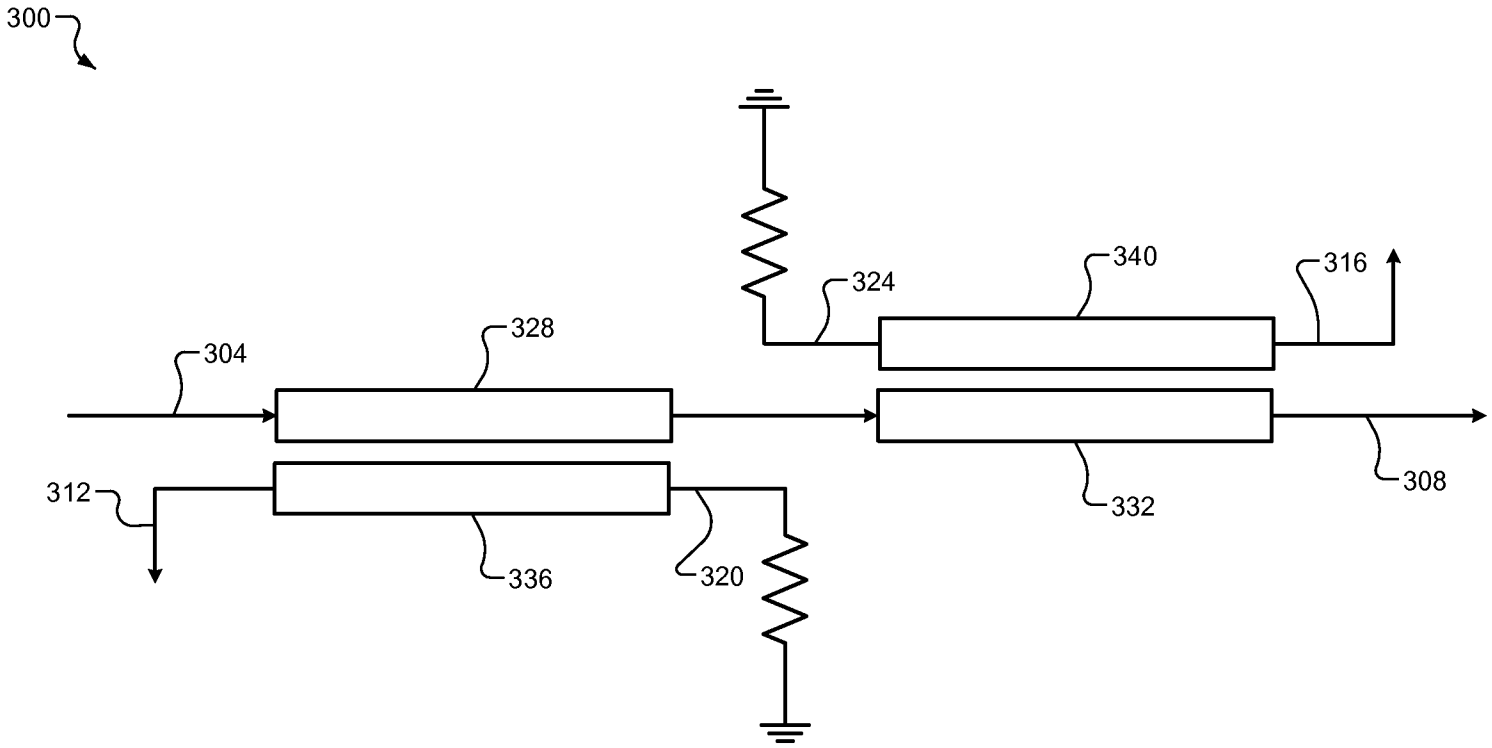
FIG. 3A Prior Art
FIG. 3A is an example dual-directional coupler in a series arrangement.
Figure 3B:
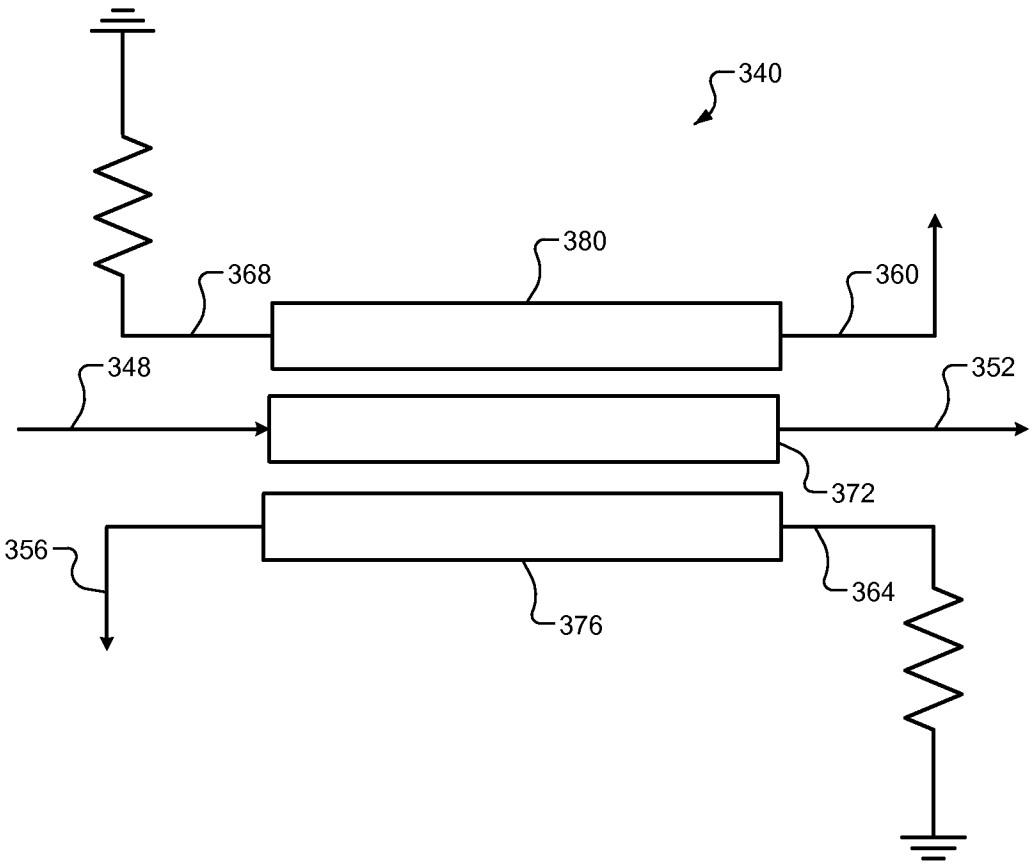
FIG. 3B Prior Art
FIG. 3B is an example dual-directional coupler in a parallel arrangement.
Figure 4:
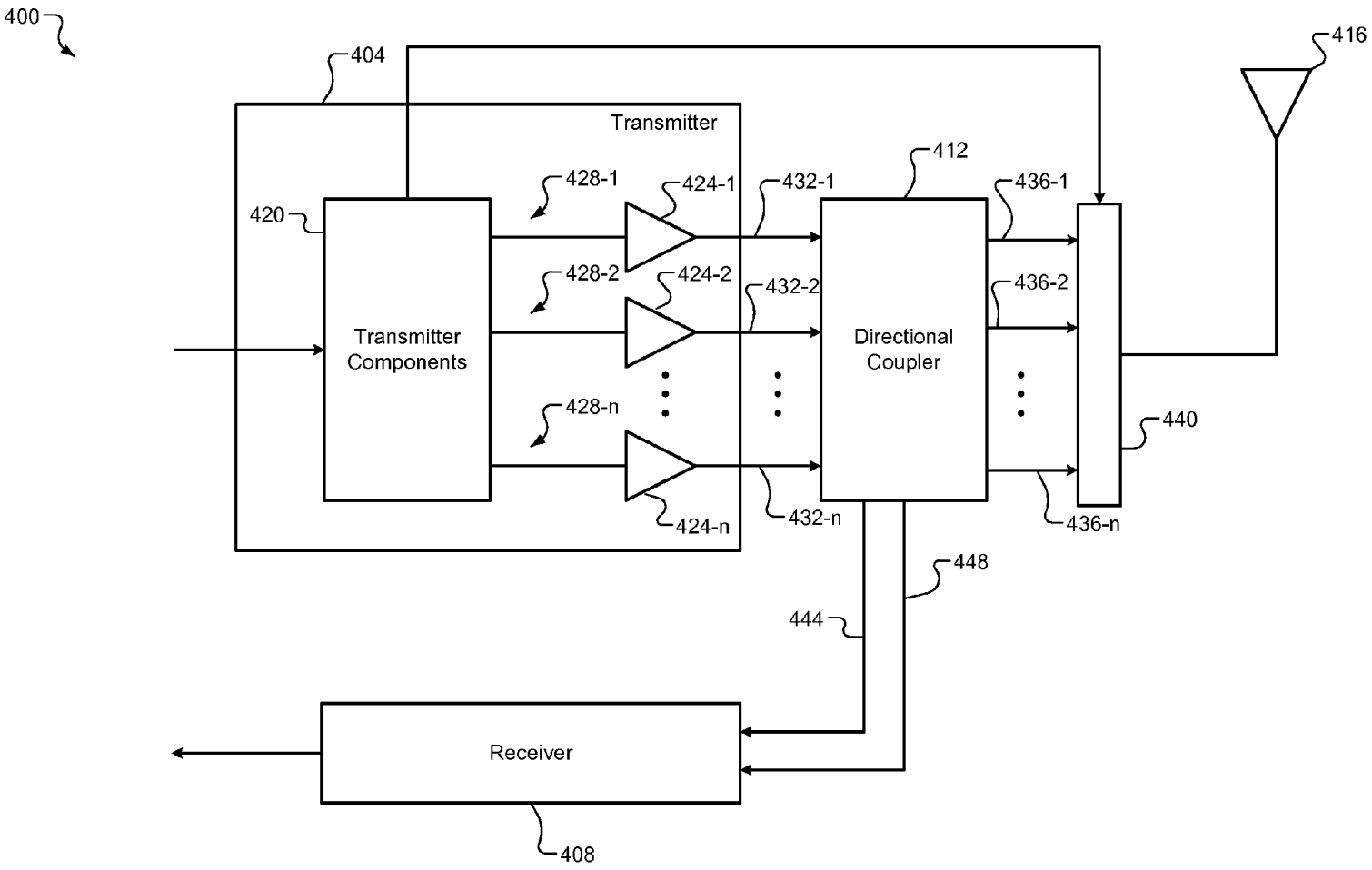
FIG. 4 is an example wireless communication device including an example two- or multi-band dual-directional coupler according to the principles of the present disclosure.

FIG. 4 shows an example wireless communication device 400 configured to operate in multiple frequency bands. The device 400 includes a transmitter 404, a receiver 408, and a directional coupler 412. The transmitter 404 generates signals to be transmitted via antenna using various transmitter components 420 (e.g., digital to analog converters, drivers, filters, etc.). The signals are provided to PAs 424-1, 424-2, . . . , and **424-*n* (referred to collectively as PAs 424) in respective transmission paths 428-1, 428-2, . . . , and 428-*n* (referred to collectively as transmission paths 428). Each of the transmission paths 428 (and respective PAs 424) may correspond to a different frequency band. For example only, the transmission paths 428 may correspond to a low band, a high band, and a very high band. The wireless communication device 400 may be configured to provide signals in only one of the transmission paths 428 at a time. For example, the wireless communication device 400** transmits signals in a band according to a currently selected band or mode.

The directional coupler 412 receives a signal from a respective one of the PAs 424 according to the selected band or mode that the wireless communication device 400 is currently operating in. For example, the directional coupler 412 receives signals from the PAs 424 via respective input ports 432-1, 432-2, . . . , and **432-*n* (referred to collectively as input ports 432) and outputs the signals via respective output ports 436-1, 436-2, . . . , and 436-*n* (referred to collectively as output ports 436). A selected one of the output ports 436 (e.g., corresponding to the selected band or mode) is connected to the antenna 416 via switch 440. For example, the switch 440 may receive a signal from the transmitter components 420 indicating which of the output ports 436 to connect to the antenna 416** based on the selected band or mode.

The directional coupler 412 includes a forward coupled port 444 and a reverse coupled port 448. Characteristics of signals on any of the inputs ports 432 and the output ports 436 are detectable via the forward coupled port 444 and the reverse coupled port 448. For example, when the transmitter 404 is operating in a selected band or mode corresponding to the PA 424-1, signal characteristics detectable on the forward coupled port 444 and the reverse coupled port 448 correspond to signals on the input port 432-1 and the output port 436-1, respectively. When the transmitter 404 is operating in a selected band or mode corresponding to the PA 424-2, signal characteristics detectable on the forward coupled port 444 and the reverse coupled port 448 correspond to signals on the input port 432-2 and the output port 436-2, respectively. When the transmitter 404 is operating in a selected band or mode corresponding to the PA **424-*n*, signal characteristics detectable on the forward coupled port 444 and the reverse coupled port 448 correspond to signals on the input port 432-*n* and the output port 436-*n***, respectively.

Figure 5:
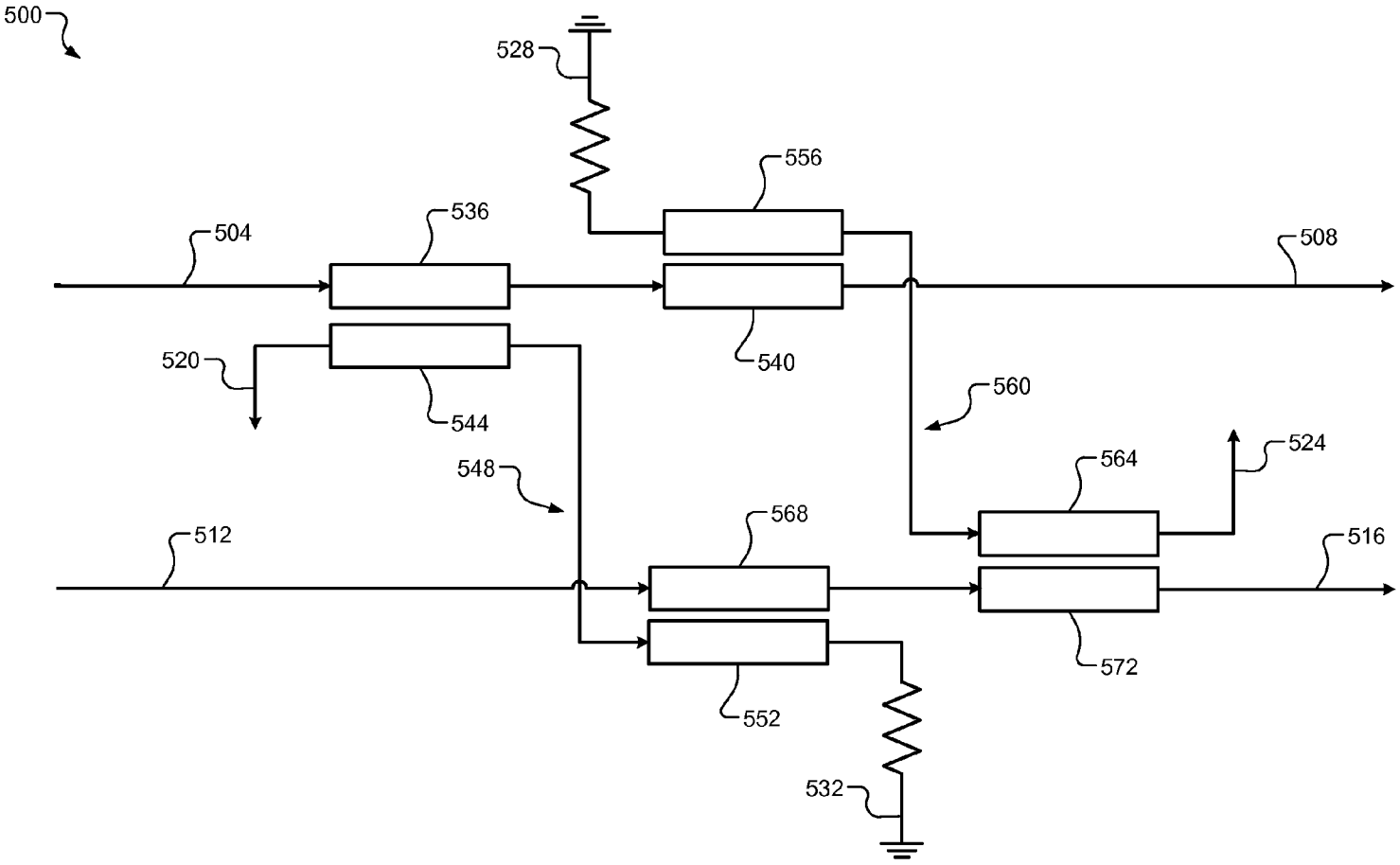
FIG. 5 is an example two-band dual-directional coupler in a series arrangement according to the principles of the present disclosure.

FIG. 5 shows an example two-band dual-directional coupler 500 in a series arrangement according to the principles of the present disclosure. The dual-directional coupler 500 includes an input port 504 and an output port 508 for a first band, an input port 512 and an output port 516 for a second band, a forward coupled port 520, a reverse coupled port 524, and terminated ports 528 and 532.

The input port 504 receives a transmit signal corresponding to a first transmission band and outputs the transmit signal via the output port 508 on a transmit line including transmit line portions 536 and 540. The transmit line portion 536 is forward coupled to a first portion 544 of a coupling line 548 having the first portion 544 and a second portion 552. The transmit line portion 540 is reverse coupled to a first portion 556 of a coupling line 560 having the first portion 556 and a second portion 564. Accordingly, signals on the transmit line portion 536 are forward coupled to the coupling line 548, and characteristics of the signals are detectable via the forward coupled port 520. Conversely, signals on the transmit line portion 540 are reverse coupled to the coupling line 560, and characteristics of the signals are detectable via the reverse coupled port 524.

The input port 512 receives a transmit signal corresponding to a second transmission band and outputs the transmit signal via the output port 516 on a transmit line including transmit line portions 568 and 572. The transmit line portion 568 is forward coupled to the second portion 552 of the coupling line 548. The transmit line portion 572 is reverse coupled to the second portion 564 of the coupling line 560. Accordingly, signals on the transmit line portion 568 are forward coupled to the coupling line 548, and characteristics of the signals are detectable via the forward coupled port 520. Conversely, signals on the transmit line portion 572 are reverse coupled to the coupling line 560, and characteristics of the signals are detectable via the reverse coupled port 524.

In other words, the two-band dual-directional coupler 500 is configured to provide forward and reverse coupling of transmission lines for two different transmission bands using the same coupling lines 548 and 560 via the same forward coupled port 520 and reverse coupled port 524, respectively. Accordingly, while the directional coupler 500 includes the input ports 504 and 512 and the output ports 508 and 516 for each of the transmission bands, the directional coupler 500 only requires one of each of the forward coupled port 520 and the reverse coupled port 524.

Figure 6:
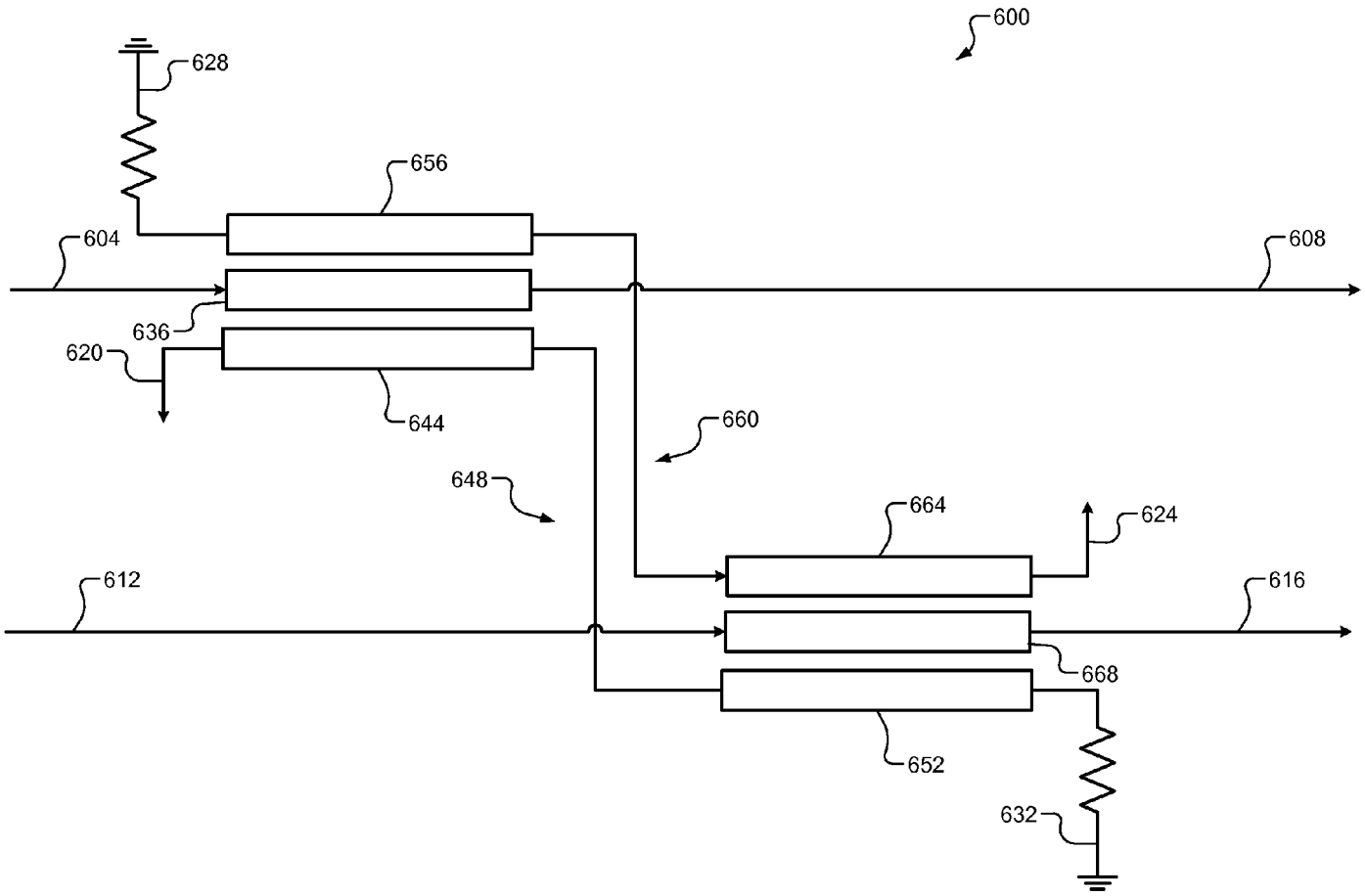
FIG. 6 is an example two-band dual-directional coupler in a parallel arrangement according to the principles of the present disclosure.

FIG. 6 shows an example two-band dual-directional coupler 600 in a parallel arrangement according to the principles of the present disclosure. The dual-directional coupler 600 includes an input port 604 and an output port 608 for a first band, an input port 612 and an output port 616 for a second band, a forward coupled port 620, a reverse coupled port 624, and terminated ports 628 and 632.

The input port 604 receives a transmit signal in a first transmit band and outputs the transmit signal via the output port 608 on a transmit line 636. The transmit line 636 is forward coupled to a first portion 644 of a coupling line 648 having the first portion 644 and a second portion 652. The transmit line portion 636 is reverse coupled to a first portion 656 of a coupling line 660 having the first portion 656 and a second portion 664. Accordingly, signals on the transmit line 636 are forward coupled to the coupling line 648, and characteristics of the signals are detectable via the forward coupled port 620. Conversely, signals on the transmit line 636 are reverse coupled to the coupling line 660, and characteristics of the signals are detectable via the reverse coupled port 624.

The input port 612 receives a transmit signal in a second transmit band and outputs the transmit signal via the output port 616 on a transmit line 668. The transmit line 668 is forward coupled to the second portion 652 of the coupling line 648. The transmit line 668 is reverse coupled to the second portion 664 of the coupling line 660. Accordingly, signals on the transmit line 668 are forward coupled to the coupling line 648, and characteristics of the signals are detectable via the forward coupled port 620. Conversely, signals on the transmit line 668 are reverse coupled to the coupling line 660, and characteristics of the signals are detectable via the reverse coupled port 624.

Accordingly, like the directional coupler 500 of FIG. 5, while the directional coupler 600 includes the input ports 604 and 612 and the output ports 608 and 616 for each of the transmission bands, the directional coupler 600 only requires one of each of the forward coupled port 620 and the reverse coupled port 624.

Figure 7:
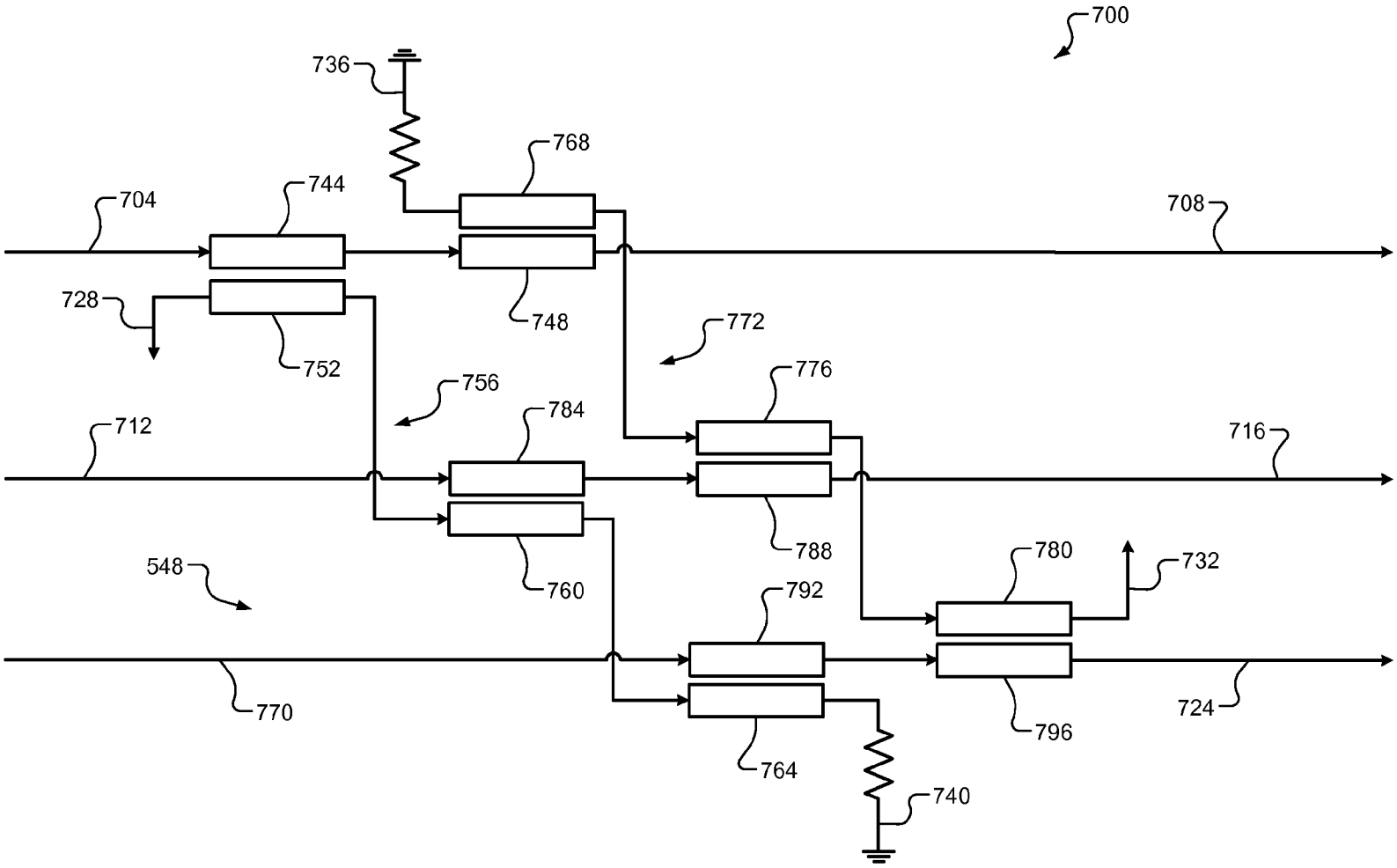
FIG. 7 is an example multi-band dual-directional coupler in a series arrangement according to the principles of the present disclosure.

FIG. 7 shows an example multi-band dual-directional coupler 700 in a series arrangement according to the principles of the present disclosure. The dual-directional coupler 700 includes an input port 704 and an output port 708 for a first band, an input port 712 and an output port 716 for a second band, an input port 720 and an output port 724 for an nth band, a forward coupled port 728, a reverse coupled port 732, and terminated ports 736 and 740.

The input port 704 receives a transmit signal corresponding to a first transmission band and outputs the transmit signal via the output port 708 on a transmit line including transmit line portions 744 and 748. The transmit line portion 744 is forward coupled to a first portion 752 of a coupling line 756 having the first portion 752, a second portion 760, and a third portion 764. The transmit line portion 748 is reverse coupled to a first portion 768 of a coupling line 772 having the first portion 768, a second portion 776, and a third portion 780. Accordingly, signals on the transmit line portion 744 are forward coupled to the coupling line 756, and characteristics of the signals are detectable via the forward coupled port 728. Conversely, signals on the transmit line portion 748 are reverse coupled to the coupling line 772, and characteristics of the signals are detectable via the reverse coupled port 732.

The input port 712 receives a transmit signal corresponding to a second transmission band and outputs the transmit signal via the output port 716 on a transmit line including transmit line portions 784 and 788. The transmit line portion 784 is forward coupled to the second portion 760 of the coupling line 756. The transmit line portion 788 is reverse coupled to the second portion 776 of the coupling line 772. Accordingly, signals on the transmit line portion 784 are forward coupled to the coupling line 756, and characteristics of the signals are detectable via the forward coupled port 728. Conversely, signals on the transmit line portion 788 are reverse coupled to the coupling line 772, and characteristics of the signals are detectable via the reverse coupled port 732.

The input port 720 receives a transmit signal corresponding to an nth transmission band and outputs the transmit signal via the output port 724 on a transmit line including transmit line portions 792 and 796. The transmit line portion 792 is forward coupled to the third portion 764 of the coupling line 756. The transmit line portion 792 is reverse coupled to the third portion 780 of the coupling line 772. Accordingly, signals on the transmit line portion 792 are forward coupled to the coupling line 756, and characteristics of the signals are detectable via the forward coupled port 728. Conversely, signals on the transmit line portion 796 are reverse coupled to the coupling line 772, and characteristics of the signals are detectable via the reverse coupled port 732.

In other words, the multi-band dual-directional coupler 700 is configured to provide forward and reverse coupling of transmission lines for n different transmission bands using the same coupling lines 756 and 772 via the same forward coupled port 728 and reverse coupled port 732, respectively. Accordingly, while the directional coupler 700 includes the input ports 704, 712, and 720 and the output ports 708, 716, and 724 for each of the transmission bands, the directional coupler 700 only requires one of each of the forward coupled port 728 and the reverse coupled port 732.

Figure 8:
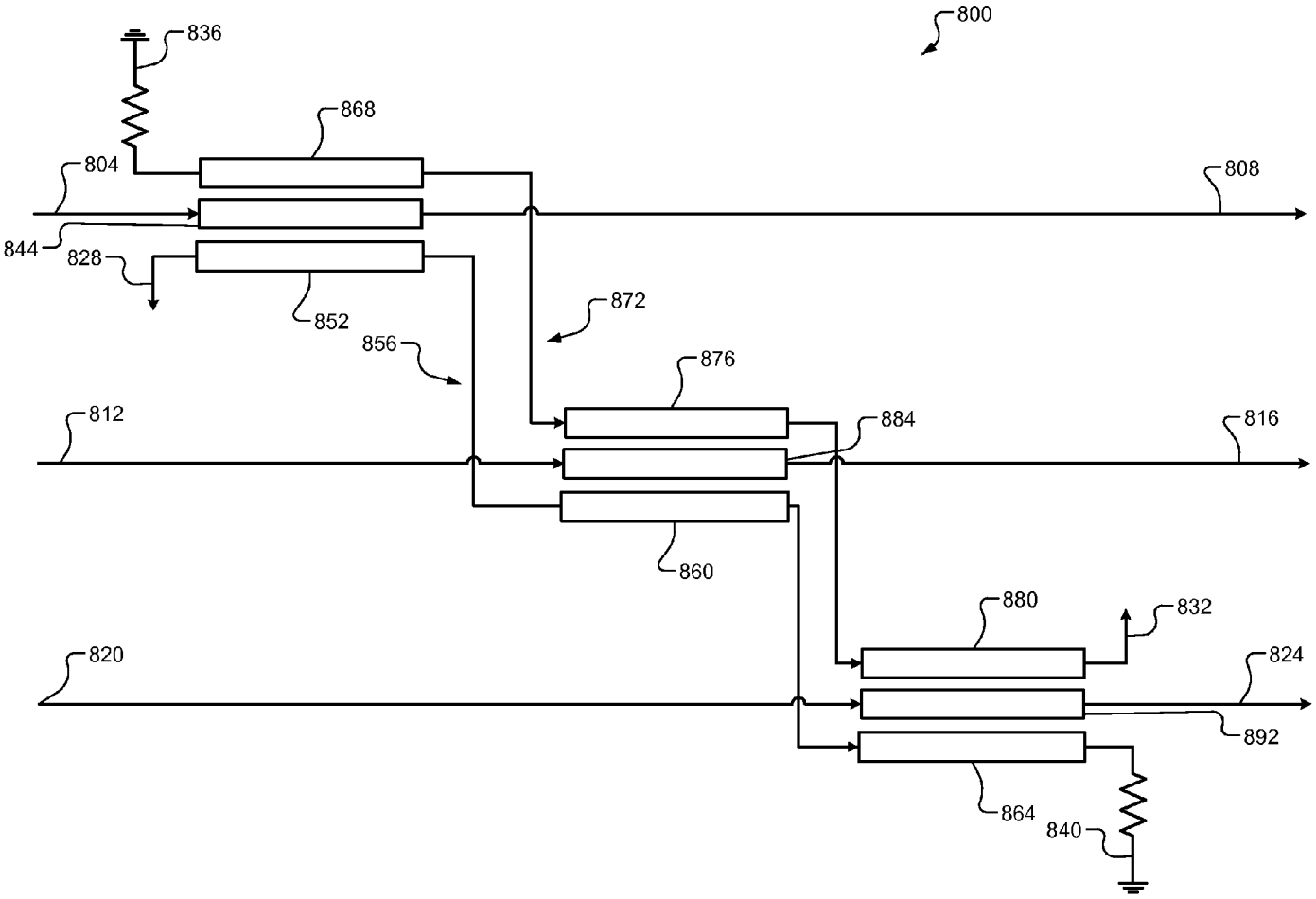
FIG. 8 is an example multi-band dual-directional coupler in a parallel arrangement according to the principles of the present disclosure.

FIG. 8 shows an example multi-band dual-directional coupler 800 in a parallel arrangement according to the principles of the present disclosure. The dual-directional coupler 800 includes an input port 804 and an output port 808 for a first band, an input port 812 and an output port 816 for a second band, an input port 820 and an output port 824 for an nth band, a forward coupled port 828, a reverse coupled port 832, and terminated ports 836 and 840.

The input port 804 receives a transmit signal corresponding to a first transmission band and outputs the transmit signal via the output port 808 on a transmit line 844. The transmit line 844 is forward coupled to a first portion 852 of a coupling line 856 having the first portion 852, a second portion 860, and a third portion 864. The transmit line 844 is reverse coupled to a first portion 868 of a coupling line 872 having the first portion 868, a second portion 876, and a third portion 880. Accordingly, signals on the transmit line 844 are forward coupled to the coupling line 856, and characteristics of the signals are detectable via the forward coupled port 828. Conversely, signals on the transmit line 844 are reverse coupled to the coupling line 872, and characteristics of the signals are detectable via the reverse coupled port 832.

The input port 812 receives a transmit signal corresponding to a second transmission band and outputs the transmit signal via the output port 816 on a transmit line 884. The transmit line 884 is forward coupled to the second portion 860 of the coupling line 856. The transmit line 884 is reverse coupled to the second portion 876 of the coupling line 872. Accordingly, signals on the transmit line 884 are forward coupled to the coupling line 856, and characteristics of the signals are detectable via the forward coupled port 828. Conversely, signals on the transmit line 884 are reverse coupled to the coupling line 872, and characteristics of the signals are detectable via the reverse coupled port 832.

The input port 820 receives a transmit signal corresponding to an nth transmission band and outputs the transmit signal via the output port 824 on a transmit line 892. The transmit line 892 is forward coupled to the third portion 864 of the coupling line 856. The transmit line 892 is reverse coupled to the third portion 880 of the coupling line 872. Accordingly, signals on the transmit line portion 892 are forward coupled to the coupling line 856, and characteristics of the signals are detectable via the forward coupled port 828. Conversely, signals on the transmit line portion 892 are reverse coupled to the coupling line 872, and characteristics of the signals are detectable via the reverse coupled port 832.

Accordingly, like the directional coupler 700 of FIG. 7, while the directional coupler 800 includes the input ports 804, 812, and 820 and the output ports 808, 816, and 824 for each of the transmission bands, the directional coupler 800 only requires one of each of the forward coupled port 828 and the reverse coupled port 832.

Figure 9:
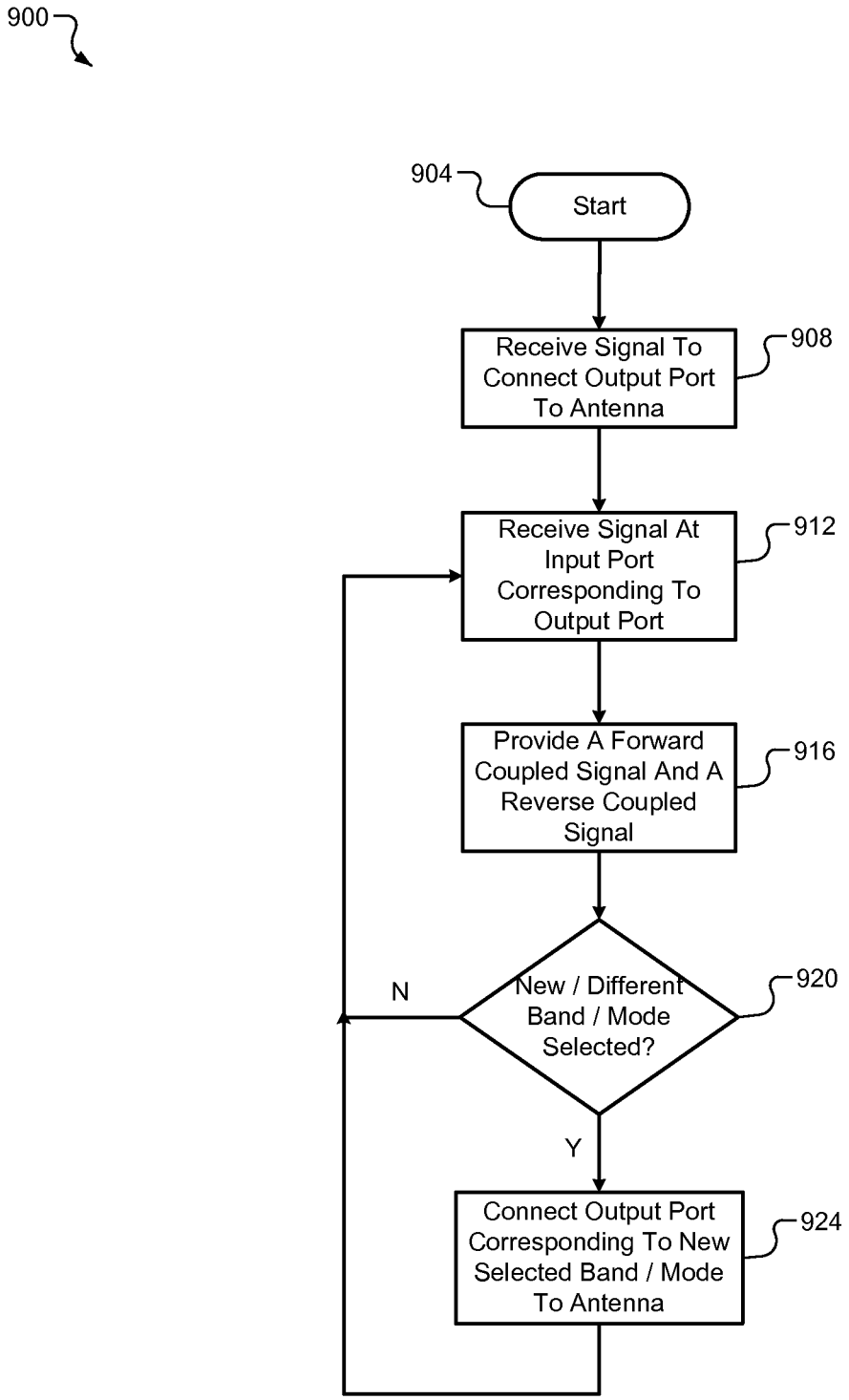
FIG. 9 illustrates an example method for operating a multi-band dual-directional coupler according to the principles of the present disclosure.

FIG. 9 shows an example method 900 for operating a multi-band dual-directional coupler according to the principles of the present disclosure. The method 900 begins at 904. At 908, the directional coupler receives a signal indicating which output port of a plurality of output ports to connect to an antenna based on a selected band or mode of a wireless communication device and connects the output port to the antenna accordingly. At 912, the directional coupler receives a signal at an input port corresponding to the output port connected to the antenna. At 916, the directional coupler provides a forward coupled signal and a reverse coupled signal of the received signal to a forward coupled port and a reverse coupled port, respectively. At 920, the method 900 determines whether a new (i.e., different from the currently selected) band or mode is selected. If true, the method 900 continues to 924. If false, the method 900 continues to 912. At 924, the method 900 connects the output port corresponding to the new selected band or mode to the antenna and then continues to 912.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A directional coupler for a wireless communication device, the directional coupler comprising:

a first transmit line having a first input port and a first output port respectively configured to receive and provide a first signal to be transmitted from the wireless communication device;

a second transmit line having a second input port and a second output port respectively configured to receive and provide a second signal to be transmitted from the wireless communication device;

a coupling line having (i) a first portion coupled to the first transmit line, (ii) a second portion, in series with the first portion, coupled to the second transmit line, and (iii) a coupled port configured to selectively provide a coupled signal corresponding to each of, in respective modes, the first signal and the second signal; and a second coupled port configured to provide a second coupled signal corresponding to each of, in respective modes, the first signal and the second signal, wherein the coupled port corresponds to a forward coupled port and the second coupled port corresponds to a reverse coupled port, the first transmit line includes a first portion and a second portion arranged in series, wherein (i) the first portion of the first transmit line is coupled to the portion of the first coupling line and (ii) the second portion of the first transmit line is coupled to a second coupling line corresponding to the second coupled port, and the second transmit line includes a first portion and a second portion arranged in series, wherein (i) the first portion of the second transmit line is coupled to the second portion of the first coupling line and (ii) the second portion of the second transmit line is coupled to the second coupling line corresponding to the second coupled port.

2. The directional coupler of claim 1, further comprising a third input port and a third output port respectively configured to receive and provide a third signal to be transmitted from the wireless communication device, wherein the coupled signal corresponds to, in a respective mode, the third signal.

3. The directional coupler of claim 1, wherein the coupled port corresponds to a forward coupled port.

4. The directional coupler of claim 1, wherein the coupled port corresponds to a reverse coupled port.

5. The directional coupler of claim 1, wherein the first signal corresponds to a first transmission band and the second signal corresponds to a second transmission band.

6. A directional coupler for a wireless communication device, the directional coupler comprising:

a first transmit line having a first input port and a first output port respectively configured to receive and provide a first signal to be transmitted from the wireless communication device;

a second transmit line having a second input port and a second output port respectively configured to receive and provide a second signal to be transmitted from the wireless communication device;

a coupling line having (i) a first portion coupled to the first transmit line, (ii) a second portion, in series with the first portion, coupled to the second transmit line, and (iii) a coupled port configured to selectively provide a coupled signal corresponding to each of, in respective modes, the first signal and the second signal; and a second coupled port configured to provide a second coupled signal corresponding to each of, in respective modes, the first signal and the second signal, wherein the first transmit line is coupled, in a parallel arrangement, to each of (i) the first portion of the first coupling line and (ii) a second coupling line corresponding to the second coupled port, and the second transmit line is coupled, in a parallel arrangement, to each of (i) the second portion of the first coupling line and (ii) the second coupling line corresponding to the second coupled port.

7. A method of operating a directional coupler for a wireless communication device, the method comprising:

receiving and providing a first signal to be transmitted from the wireless communication device at a first input port and a first output port, respectively, of a first transmit line;

receiving and providing a second signal to be transmitted from the wireless communication device at a second input port and a second output port, respectively, of a second transmit line;

using a coupled port having (i) a first portion coupled to the first transmit line and (ii) a second portion, in series with the first portion, coupled to the second transmit line, selectively providing a coupled signal corresponding to each of, in respective modes, the first signal and the second signal;

providing, at a second coupled port, a second coupled signal corresponding to each of, in respective modes, the first signal and the second signal, wherein the coupled port corresponds to a forward coupled port and the second coupled port corresponds to a reverse coupled port;

coupling the first portion of the first coupling line to a first portion of the first transmit line;

coupling a second coupling line corresponding to the second coupled port to a second portion of the first transmit line, wherein the first portion of the first transmit line and the second portion of the first transmit line are arranged in series;

coupling the second portion of the first coupling line to a first portion of the second transmit line; and coupling the second coupling line to a second portion of the second transmit line, wherein the first portion of the second transmit line and the second portion of the second transmit line are arranged in series.

8. The method of claim 7, further comprising receiving and providing a third signal to be transmitted from the wireless communication device at a third input port and a third output port, respectively, wherein the coupled signal corresponds to, in a respective mode, the third signal.

9. The method of claim 7, wherein the coupled port corresponds to a forward coupled port.

10. The method of claim 7, wherein the coupled port corresponds to a reverse coupled port.

11. The method of claim 7, wherein the first signal corresponds to a first transmission band and the second signal corresponds to a second transmission band.

12. A method of operating a directional coupler for a wireless communication device the method comprising:

receiving and providing a first signal to be transmitted from the wireless communication device at a first input port and a first output port, respectively, of a first transmit line;

receiving and providing a second signal to be transmitted from the wireless communication device at a second input port and a second output port, respectively, of a second transmit line;

using a coupled port having (i) a first portion coupled to the first transmit line and (ii) a second portion, in series with the first portion, coupled to the second transmit line, selectively providing a coupled signal corresponding to each of, in respective modes, the first signal and the second signal;

providing, at a second coupled port, a second coupled signal corresponding to each of, in respective modes, the first signal and the second signal;

coupling, in a parallel arrangement, the first transmit line to each of (i) the first portion of the first coupling line and (ii) a second coupling line corresponding to the second coupled port; and coupling, in a parallel arrangement, the second transmit line to each of (i) the second portion of the first coupling line and (ii) the second coupling line corresponding to the second coupled port.

* * * * *